US006789632B2

(12) United States Patent
Green

(10) Patent No.: US 6,789,632 B2
(45) Date of Patent: Sep. 14, 2004

(54) ROCK DRILLING APPARATUS

(75) Inventor: Christopher J. Green, Halifax (GB)

(73) Assignee: Halco Drilling International Limited (GB)

( * ) Notice: Subject to any disclaimer, the term of this patent is extended or adjusted under 35 U.S.C. 154(b) by 7 days.

(21) Appl. No.: 10/375,776

(22) Filed: Feb. 27, 2003

(65) Prior Publication Data

US 2004/0016574 A1 Jan. 29, 2004

(30) Foreign Application Priority Data

Mar. 1, 2002 (GB) ..... 0204904

(51) Int. Cl.[7] ..... E21B 4/06
(52) U.S. Cl. ..... 175/300; 175/414; 173/133
(58) Field of Search ..... 175/414, 415, 175/417, 293, 300, 306, 325.1, 325.5, 325.6, 325.7; 173/133, 132

(56) References Cited

U.S. PATENT DOCUMENTS

| | | | | |
|---|---|---|---|---|
| 5,065,827 A | | 11/1991 | Meyers et al. | |
| 5,168,944 A | * | 12/1992 | Andersson | 175/321 |
| 5,647,447 A | | 7/1997 | Jones | |
| 6,070,678 A | | 6/2000 | Pascale | |
| 2003/0116359 A1 | * | 6/2003 | Richter et al. | 175/417 |
| 2004/0011565 A1 | * | 1/2004 | Lyon et al. | 175/296 |
| 2004/0084225 A1 | * | 5/2004 | Fisher | 175/414 |

FOREIGN PATENT DOCUMENTS

| | | |
|---|---|---|
| WO | WO 98/05476 | 2/1998 |

* cited by examiner

*Primary Examiner*—David Bagnell
*Assistant Examiner*—Daniel P Stephenson
(74) *Attorney, Agent, or Firm*—Arnold B. Silverman; Eckert Seamans Cherin & Mellott, LLC

(57) ABSTRACT

A rock drilling apparatus includes a drill string terminating in a drill chuck (32) and a drill bit (16) detachably fitted into the drill chuck, the drill bit having a shank (18) received in the drill chuck, the drill chuck (32) and the drill bit shank (18) having complementary splines and grooves allowing rotation or movement of the drill chuck to be transmitted to the drill bit whilst allowing limited longitudinal movement of the drill chuck relative to the drill bit. The drill bit has a drill head (22) at its lower end which is of greater diameter than said shank, said head having a part (26) above that lower end and below the splined region. The part (26) and the surrounding part (38) of the chuck provides respective parts of a bayonet connection arrangement which is substantially unstressed in normal operation of the drill, the arrangement being such that, in normal operation, the weight of the drill string and the weight of the drill bit during lifting of the drill string are supported by complementary formations on the drill shank and the chuck, whereas the bayonet connection arrangement prevents complete detachment of the drill bit head from the chuck in the event of a fracture of the bit above the drill head.

3 Claims, 5 Drawing Sheets

ROCK DRILLING APPARATUS

BACKGROUND OF THE INVENTION

1. Field of the Invention

This invention relates to rock drilling equipment and more particularly drilling equipment utilised for drilling oil well bores and the like.

2. Description of the Prior Art

A problem which arises in operation of rock drilling equipment of the kind referred to is that occasionally the head of the operative end of the drill bit will break off from the remainder of the drill bit, due to the stresses arising in drilling and, in the absence of measures taken to prevent this, the broken off head of the drill will remain at the bottom of the bore being drilled and thus possibly many hundreds of feet below the surface. If the remainder of the drill string, with the remainder of the bit, is then withdrawn from the bore and the broken drill bit replaced, drilling of the bore cannot be resumed until the broken-off drill bit head is recovered, as otherwise the new drill bit would be bearing upon the broken drill bit head within the bore and not upon the rock. would present an inpenetratable barrier to the new drill bit and would merely result in the new drill bit in turn becoming hopelessly damaged. Various schemes have been proposed in the past for retrieving broken drill bit parts from bores or for ensuring that, should the operative part or head of a drill bit break off from the remainder, that drill bit head will nevertheless be retained on the end of the drill string allowing it to be retrieved from the bore with the drill string when the string is lifted from the bore. It is an object of the present invention to provide an improved arrangement of the latter sort.

SUMMARY OF THE INVENTION

According to the present invention, there is provided a rock drilling apparatus including a drill string terminating in a drill chuck and a drill bit detachably fitted into the drill chuck, the drill bit having a shank received in the drill chuck, the drill chuck and the drill bit shank having complementary non circular cross-section portions allowing rotational movement about the drill axis to be imparted to the drill bit via the drill chuck whilst allowing limited longitudinal movement of the drill chuck relative to the drill bit, the drill bit shank and the chuck having complementary formations above a first location along the drill bit, for limiting downward movement of the drill bit in the drill chuck, the drill bit having a drill head at its lower end which is of greater diameter than said shank, said head having a retaining formation above said lower end and the below said first location which is of greater diameter than the drill bit is at said first location, which retaining formulation co-operates with complementary retaining means on said chuck so as to prevent the complete detachment of said drill bit head from the chuck in the event of a fracture of the drill bit at said first location, and wherein said retaining formation on the drill bit head and the complementary retaining formation on the chuck take the form of respective parts of a bayonet connection arrangement which is substantially unstressed in normal operation of the drill, the arrangement being such that, in normal operation, the weight of the drill string, and the weight of the drill bit during lifting of the drill string, are supported by said complementary formations, above said first location which likewise receive the stresses imparted to the drill bit to cause a rotational movement of the drill bit.

Preferably the bit head retaining arrangement includes means associated with the arrangement for preventing rotation of the drill bit head relative to the chuck assembly without disassembly of the chuck assembly.

An embodiment of the invention is described below by way of example with reference to the accompanying drawings in which:

DESCRIPTION OF THE PREFERRED EMBODIMENTS

Figure 1:
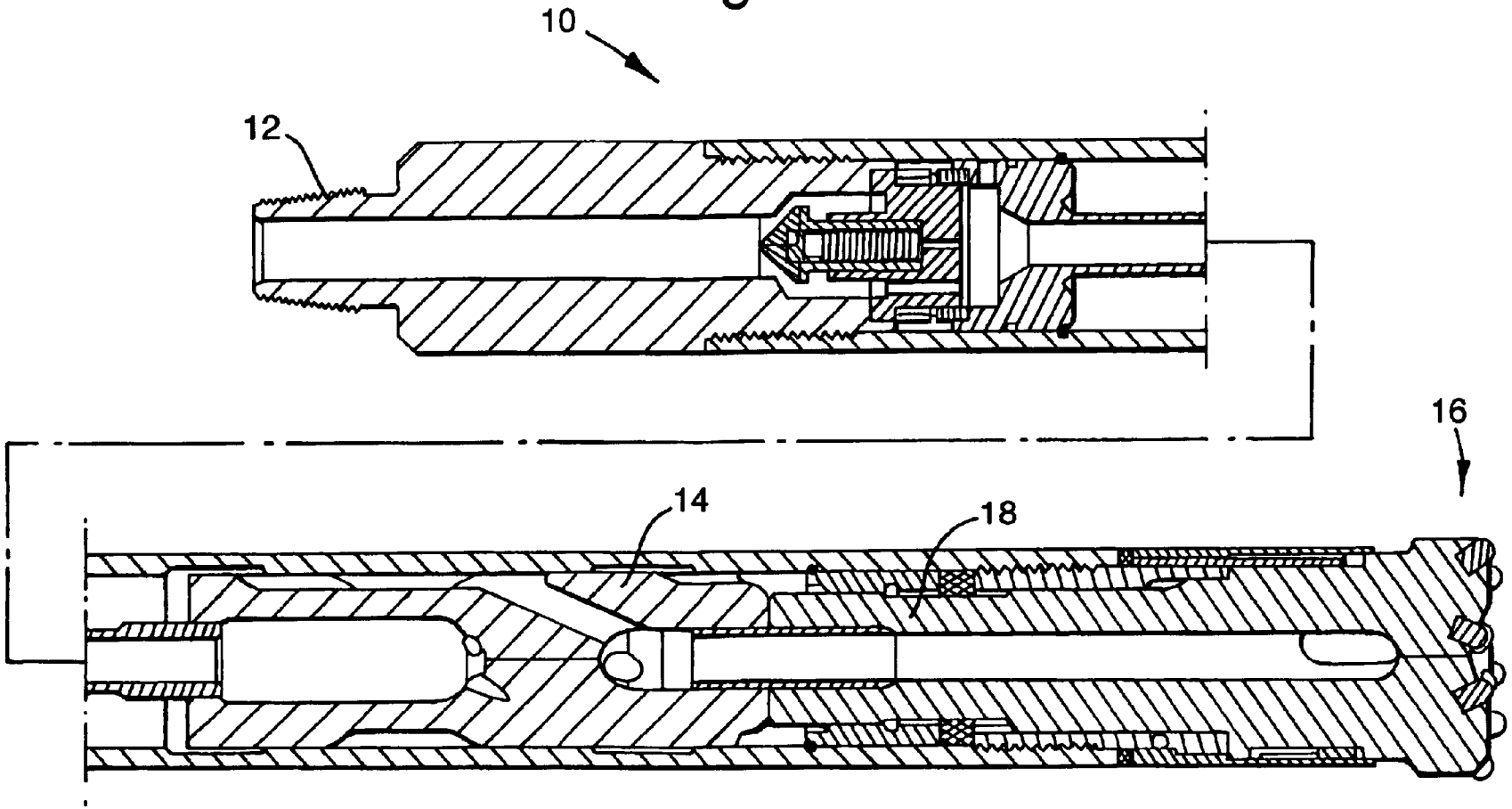
FIG. 1. is a view in axial section of the lower most part of a rock drilling string including a drill bit and a drill chuck assembly in accordance with the present invention.

Referring to the drawings, FIG. 1 shows the final, lowermost section 10 of a drill string of a drilling apparatus incorporating the invention. The final section shown is conventional apart from the drill bit, the bit-retaining part of the chuck, the bit catcher and the bit catcher gates to be described below. Accordingly, the conventional parts are not described in detail below. However it will be noted that the drill-string section 10 shown comprises at the rear end (i.e. the uppermost end in use) a tapered screw-threaded stub by which the section 10 can be attached to the remainder of the drill string (not shown). The drill string, of course, normally comprises a series of tubular sections connected together end to end by complementary screw threaded stubs and sockets, the string at its end remote from the drill bit being connected, in manner known per se, to means for rotating the drill string, and hence the drill bit, and for supplying compressed air to the section 10, the compressed air, in use, operating a hammer 14 in the form of longitudinally reciprocable piston which, in operation, repeatedly strikes the upper end of the shank 18 of a drill bit 16, again in a manner known per se.

Figure 2:
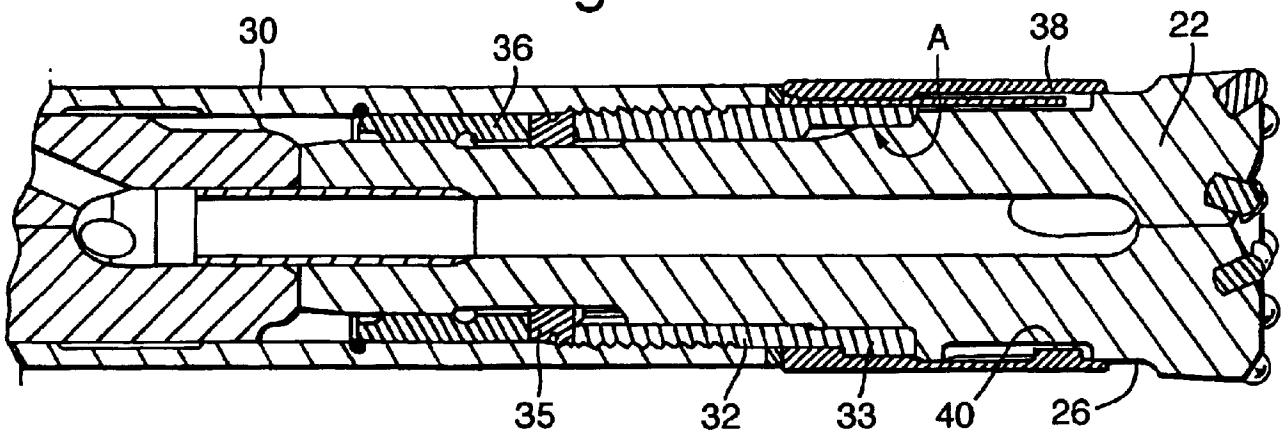
FIGS. 2, 3 and 4 are a fragmentary axial section views to a larger scale as compared to FIG. 1, showing the drill bit and adjoining parts of the assembly in normal operation and (FIG. 4) during withdrawal of the assembly after fracture of the drill bit.
Figure 3:
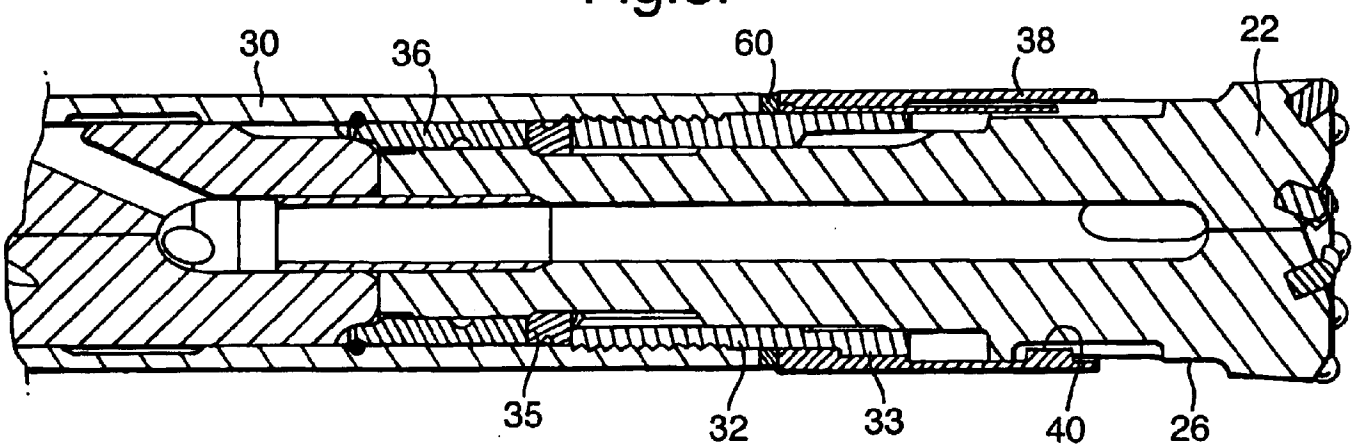

The drill bit, also in known manner, has a central axial passageway leading to ports on the operative end face of the drill bit so that exhaust air from the hammer mechanism can assisting in flushing debris from the region of the drill face. The drill bit 16 comprises a head portion 22 which may be regarded as the region below/in front of a location A, indicated in FIG. 2 and the shank 18 which may be regarded as the portion above/behind the location A, in FIG. 2. The bit 16 has its widest diameter at its free operative end face (its diameter at this point being somewhat greater than the maximum outer diameter of the remainder of the drill string) and the drill bit tapers somewhat from its operative end face and connects with a reduced diameter head part 26 via a radiused portion. The portion 26 is cylindrical apart from recesses which, as described in detail below, define part of a bayonet connection arrangement. The portion 26 in turn connects with the shank portion 18 of the bit via a further radiused portion adjacent said location A, the drill shank 18, at the location A and for some distance rearwardly of location A being of reduced diameter compared to portion 26.

Figure 5:
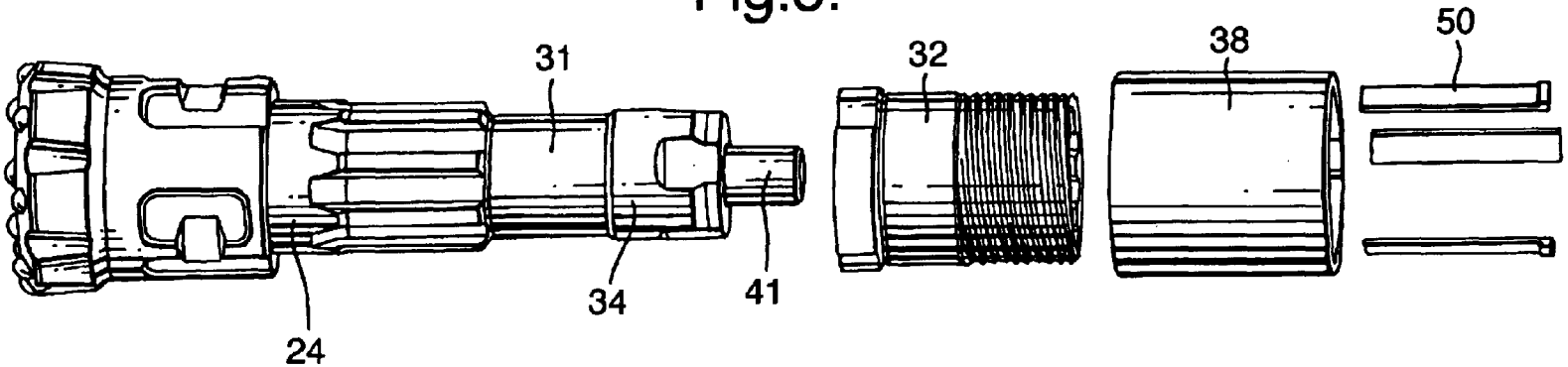
FIG. 5 is an exploded view of part of the assembly.
Figure 6:
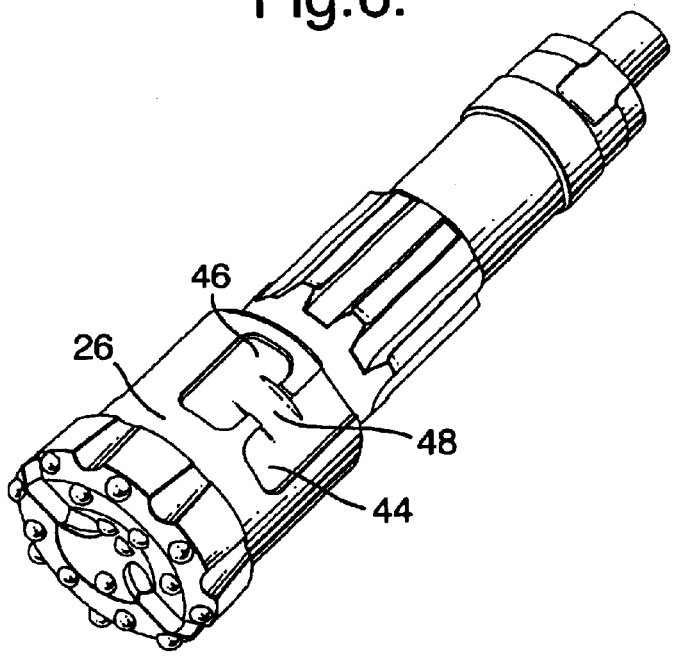
FIG. 6 is a perspective view of the drill bit in accordance with the invention.

As shown in FIG. 5 and FIG. 6, part 24 of the surface of the shank adjacent location A (i.e. nearer to the head portion) is a smooth continuous cylindrical surface for a short distance rearwardly of the head portion 26, and the shank portion rearwardly of this smooth part 24 is longitudinally grooved to form a set of alternating splines and grooves. The splined portion terminates in an annular shoulder at the junction between the splined portion and a smooth cylindrical portion 31 of still further reduced diameter extends rearwardly from the splined portion. The portion 31, in turn, is adjoined at its rear end by an end portion 34 which is of a greater diameter than the portion 31 but of somewhat lesser diameter than twice the radius of the splined part of the shank measured to the bottom of the gooves in the splined portion. A tubular air duct member 40 is secured in the rear end of the drill bit shank in the longitudinal central passage therethrough.

The final section 10 of the drill string comprises, in known manner, an outer tube or casing 30 which is internally screw threaded at its lower end to receive a complementary externally screw-threaded upper part of a main chuck part 32. The main chuck part 32 is itself internally cylindrical having at its lower end a smooth internal cylindrical surface to receive, as a sliding fit, the smooth continuous cylindrical portion 24 of the drill bit shank immediately above the location A, the remainder of the internal surface of the main chuck part 32 being longitudinally splined to receive, as a sliding fit, the splined portions of the drill bit shank. Located within the tubular casing 30 above the main chuck part 32 is a bit retaining ring 35, which may be a split resilient ring and which receives the portion 31 of the drill bit shank as a close sliding fit but which, in its installed state, is too small in diameter, internally, to pass over the end portion 34 of the drill bit shank. Also, mounted within the tubular casing 30 above the bit retaining ring 35, is a bush 36 which can receive the end portion of 34 of the drill bit shank as a close sliding fit. At its lower end, the main chuck part 32 has a portion 33 of greater diameter externally than the remainder of the main chuck part to provide an upwardly facing annular shoulder.

Figure 7:
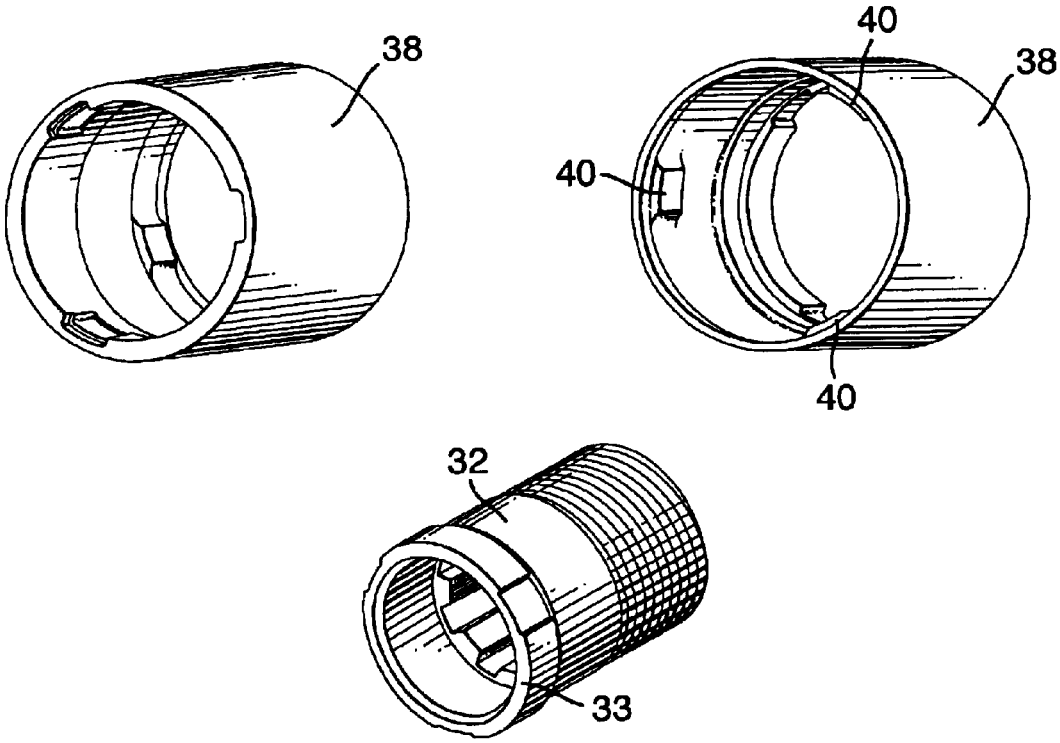
FIG. 7 shows in perspective, parts of the chuck assembly.

A bit catcher 38, in the form of a tubular sleeve, fits over the lower end of the main chuck part 32 and rests on the last-noted annular shoulder. More particularly, the bit catcher 38 has adjacent its upper end a portion which is internally smooth and cylindrical (apart from longitudinal grooves therethrough as discussed below) and of smaller internal diameter than the remainder of the bit catcher and which snugly fits over the externally cylindrical surface of the main chuck part 32, (or at least over the region just above the end part 33). The bit catcher 38 has, adjoining its upper end portion, a cylindrical internal surface of slightly greater internal diameter which is a snug fit over the lower end portion of the main chuck part 32. The remainder of the bit catcher 38 is internally cylindrical and of an even greater diameter such as to be a sliding fit over the cylindrical portion 26 of the drill bit head, apart from lugs 40 which project inwardly from the internal surface of the bit catcher and are located adjacent to the lower end of the bit catcher 38. These lugs 40 are accommodated in the recesses, referred to above, in the surface of portion 26 of the drill bit head. As best shown in FIG. 7, in the embodiment illustrated there are three such lugs 40 around the interior of the bit catcher, spaced apart at 120° intervals around the drill axis, and corresponding to these, three similarly spaced longitudinal grooves in the upper portion of the bit catcher. The number of lugs 40 and corresponding grooves may, of course, be greater than or less than three.

As shown in FIG. 6, the recesses in the otherwise cylindrical surface of portion 26 of the drill bit head comprise a plurality (in the preferred embodiment 3) of formations each comprising a longitudinal groove part 44 which extends through the shoulder formed where the portion 26 connects with the shank 18. Each groove 44 has a closed (blind) lower end. Each of these formations further comprises a generally rectangular recess 46 adjoining the respective groove 44 and extending parallel therewith, the recess 46 being blind at its upper and lower ends. Finally, each of these formations further comprises a connecting slot 48 which extends circumferentially from the groove 44 to the recess 46 and thus provides communication between the two. Each connecting slot is of lesser axial extent than the recesses 46 and is disposed about half-way along its respective recess 46.

Further features of the recesses and grooves formed in portion 26 and of the lugs 40, etc., in the bit catcher will be evident to those skilled in the art from the following brief description of the assembly sequence with reference to FIG. 5, and FIGS. 8–10.

In a first assembly stage, (FIG. 8), the main chuck part 32 is slipped over the bit shank 18 from the rear end thereof is such a way that the splines on the bit shank engage in the complementary grooves in the interior of the main chuck part, until the lower end of the main chuck part rests upon the shoulder formed at the junction of portion 26 of the bit head with the shank 18, (adjoining location A). Thereafter, as shown as FIG. 9, the bit catcher 38 is slid over the rear end of the drill bit shank and over the main chuck part 32. The bit catcher 38 is positioned angularly about the drill bit axis so that the lugs 40 correspond in position with respective ones of the slots of 44. The bit catcher is then advanced until the lugs 40 come into register with the slots 48 and the bit catcher 38 is then rotated to move the lugs 40 into the recesses 46. Thus, the connection between the bit catcher and the drill bit head can be regarded as a species of bayonet connection.

Figure 10:
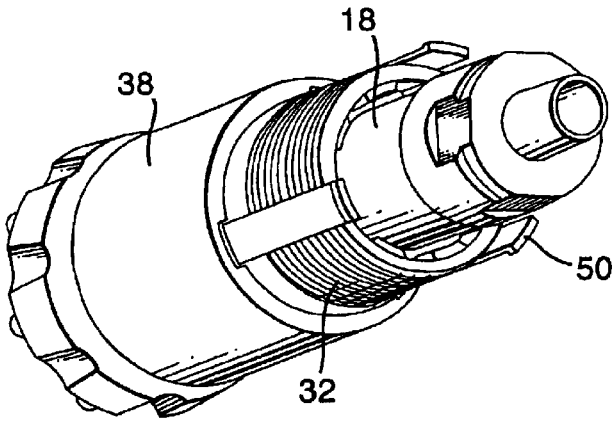
FIG. 10 is again a perspective view showing a yet further assembly stage.

Finally, as shown in FIG. 10, retaining elements or gates 50 are inserted through slots in the rear (upper) end of the bit catcher 38 into respective ones of the grooves 44, to prevent reverse rotation of the bit catcher such as would allow the lugs 42 to pass from recesses 46 into grooves 44. As shown in FIG. 10 and FIGS. 2–4, these gates 50 are quasi-rectangular elongated strips which are of uniform width measured circumferentially of the bit assembly and of uniform thickness measured radially of the assembly, apart from their rear upper ends which are of somewhat enlarged radial dimension for retention in correspondingly enlarged upper end parts of the slots in the upper end of the bit catcher 38. The end portion 33 of the main chuck part 32 also has longitudinal grooves across its periphery to receive the gates 50. In the embodiment shown, in which the bit catcher has three lugs 40 and three slots in its upper end, there are three gates 50 and correspondingly three longitudinal grooves across the periphery of the end portion 33. Again, the number of these items could, of course, be greater than or less than three. In the assembled condition when the gates 50 have been fully inserted into their respective grooves 44 and slots in the bit catcher 38, the upper ends of the gates 50 are flush with the upper end of the bit catcher. A washer 60 is then fitted over the main chuck part to rest on the upper ends of the bit catcher and the gates 50 and the resulting bit/chuck assembly is screwed into the lower end of the casing 30 with the final position being as shown FIGS. 2 and 3 and the last-noted washer being clamped between the lower end of casing 3 and the upper end of the bit catcher 38.

For convenience, the bit catcher 38 has been described herein and is referred to in the claims as being part of the chuck.

It will be appreciated that the bayonet-like connection between the bit catcher and the main chuck part might be reversed, i.e. the grooves, recesses and interconnecting slots could be formed in the internal cylindrical surface of the bit catcher sleeve and the lugs 40 could be formed on the exterior of bit head.

It should be appreciated that the dimensions of the various parts are selected so that, in normal use, i.e. unless the bit is broken, downward movement of the bit relative to the chuck is limited by engagement of the shoulder at the lower edge of portion 34 of the bit shank with the bit retaining ring 35 before any lug 40 engages the upper end of its recess 46 and that likewise, upward movement of the drill bit relative to the chuck main part 32 is limited by engagement of the lower end of the main chuck part 32 with the shoulder at the upper end of the bit head portion 26 before any lug 40 engages the lower end of its respective recess 46. Consequently, the lugs 40 are unstressed as long as the bit remains unbroken.

Figure 4:
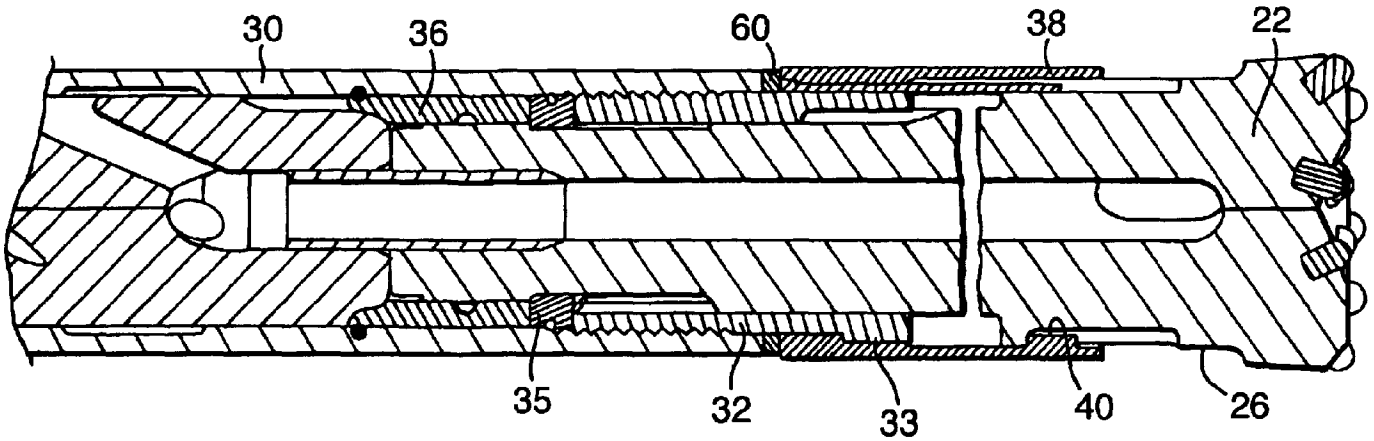
Figure 8:
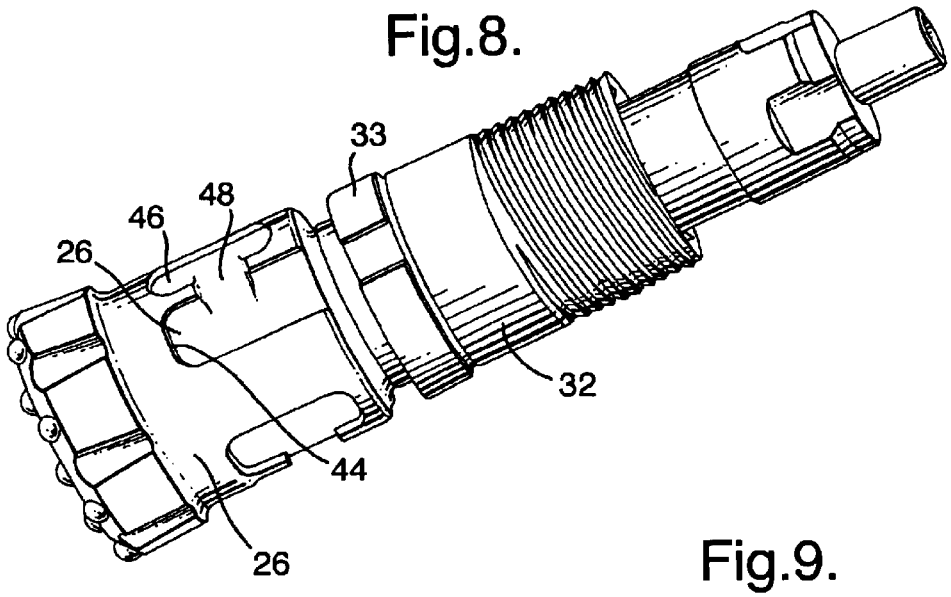
FIG. 8 shows a perspective side view showing a first assembly stage.
Figure 9:
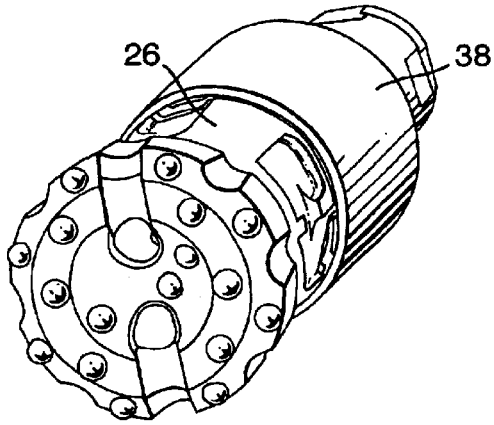
FIG. 9 shows a perspective view showing a further assembly stage.

In the event of the drill bit fracturing, which will typically occur in the drill shank rather than the greater-diameter drill bit head, and typically, as shown in FIG. 4, in the region of location, A (i.e. in the region where the drill shank connects with the drill bit head), the head portion of the drill bit will drop until it is retained by engagement of the lugs 40 with the upper ends of the recesses 46. The gates 50 occupy the grooves 44 and thus prevent rotation of the drill bit head in relation to the bit catcher. As best shown in FIGS. 7 and 8, and as noted above, the outer peripherally of the lower end 33 of the main chuck part 32 is provided externally with longitudinally extending slots or grooves which receive the gates 50.

In the event of the head of the drill bit breaking away from the bit shank, when the drill string is lifted, the head will slide down until it is retained by the lugs 40 within the bit catcher. The drill bit head will thus remain attached to the lower end of the drill string. The catcher arrangement disclosed makes it possible to rotate the drill string together with the broken drill bit head whilst withdrawing the drill string from the drill hole. This helps to prevent the drill bit head snagging in the hole on retrieval of the broken bit.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A rock drilling apparatus including a drill string terminating in a drill chuck and a drill bit detachably fitted into the drill chuck, the drill bit having a shank received in the drill chuck, the drill chuck and the drill bit shank having complementary non circular cross-section portions allowing rotational movement about the drill axis to be imparted to the drill bit via the drill chuck whilst allowing limited longitudinal movement of the drill chuck relative to the drill bit, the drill bit shank and the chuck having complementary formations above a first location along the drill bit, for limiting downward movement of the drill bit in the drill chuck, the drill bit having a drill head at its lower end which is of greater diameter than said shank, said head having a retaining formation above said lower end and below said first location which is of greater diameter than the drill bit is at said first location, which retaining formation co-operates with complementary retaining means on said chuck so as to prevent the complete detachment of said drill bit head from the chuck in the event of a fracture of the drill bit at said first location, and wherein said retaining formation on the drill bit head and the complementary retaining formation on the chuck take the form of respective parts of a bayonet connection arrangement which is substantially unstressed in normal operation of the drill, the arrangement being such that, in normal operation, the weight of the drill string, and the weight of the drill bit during lifting of the drill string, are supported by said complementary formations above said first location which likewise receive the stresses imparted to the drill bit to cause a rotational movement of the drill bit.

2. Rock drilling apparatus according to claim 1, wherein the bit head retaining arrangement includes means associated with the arrangement for preventing rotation of the drill bit head relative to the chuck assembly in the event of a fracture of the drill bit at said first location.

3. Rock drilling apparatus according to claim 2, wherein said means for preventing rotation of the drill bit head includes gate members inserted in longitudinal slots in the chuck and in said drill bit head.

* * * * *